US006478598B1

(12) United States Patent
Szu

(10) Patent No.: US 6,478,598 B1
(45) Date of Patent: Nov. 12, 2002

(54) ELECTRICAL CONNECTOR HAVING IMPROVED CONTACTS

(75) Inventor: Ming-Lun Szu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/013,585

(22) Filed: Dec. 7, 2001

(51) Int. Cl.[7] ..... H01R 4/50
(52) U.S. Cl. ..... 439/342; 439/857
(58) Field of Search ..... 439/342, 856, 439/857, 259

(56) References Cited

U.S. PATENT DOCUMENTS 3,824,557 A * 7/1974 Mallon ..... 439/381
3,989,331 A * 11/1976 Hanlon ..... 439/70
4,317,609 A * 3/1982 Lapraik ..... 439/636
4,519,660 A * 5/1985 Ichimura et al. ..... 439/268
5,044,973 A * 9/1991 Noda et al. ..... 439/264
5,299,950 A * 4/1994 Kaneko ..... 439/342
5,529,511 A * 6/1996 Matsuoka ..... 439/259
5,797,774 A * 8/1998 Kaneko ..... 439/342
6,267,615 B1 * 7/2001 Lin ..... 439/342

* cited by examiner

*Primary Examiner*—Tho D. Ta
(74) *Attorney, Agent, or Firm*—Wei Te Chung

(57) ABSTRACT

An electrical connector has improved contacts for electrically connecting pins of an external electrical device with a printed circuit board. The contact includes a base portion, a receiving portion, and a tail portion. The receiving portion has two head portions and two spring arms. One bent line is defined between the spring arm and the head portion. Another bent line is defined between the spring arm and the base portion. The receiving portion is bend along the two bent lines to achieve pin receiving and engaging function.

3 Claims, 4 Drawing Sheets

ELECTRICAL CONNECTOR HAVING IMPROVED CONTACTS

BACKGROUND OF THE INVENTION

1. Field of the Invention

The present invention relates to electrical connectors, and more particularly to an electrical connector having improved contacts for electrically connecting a central processing unit (CPU) to a printed circuit board (PCB).

2. Description of the Prior Art

Conventional CPU sockets have contacts for electrically connecting CPUs to PCBs. Tail portions of the contacts are soldered to the PCBs, and receiving portions of the contacts are electrically mated with pins of the CPUs. During CPUs mating with the sockets, the pins of the CPUs are inserted into the CPU sockets with zero insertion force, i.e., the pins of the CPUs do not contact with the contacts, therefore the contacts have no deformation. Then, the pins of the CPUs are actuated to engage with the contacts of the CPU sockets. The pins engage with the contacts, therefore the contacts have deformation. Since contact arms of the conventional contacts are short, they may subject to plastic deformation. Plastic deformation of the contact arms may cause failure of the electrical connection between the pins and the contacts and even damage of the fragile pins of the CPU.

As shown in FIG. 6, a contact 9 of a CPU socket (not shown) comprises a base portion 90, a receiving portion with two contact arms 94 extending from one end of the base portion 90, and a tail portion 92 extending from the other end of the base portion 90. The contact arms 94 form a receiving space 96 for receiving one pin of a pin grid array packaged CPU (not shown), and an engaging space 98 for clipping and electrically connecting with the pin. The pin is inserted into the receiving section 96 firstly, and then the pin is actuated to electrically connect with engaging surfaces 940 of the two contact arms 94. When the pin is situated in the engaging space 98, due to the short length of the contact arms 94, the contact arms 94 tend to undergo undesired plastic deformation and this may result in failure of the electrical connection between the pin of the CPU and the contact 9 of the CPU socket.

Accordingly, a CPU socket with improved contacts is desired to overcome the shortcoming of the conventional CPU socket.

SUMMARY OF THE INVENTION

An object of the present invention is to provide an electrical connector having improved contacts with perfect elastic deformation character for securely engaging with pins of an external electrical device.

To achieve the above object, Contacts for electrically connecting pin of an external electrical device with a printed circuit board. Each contact comprises a base portion, a receiving portion, and a tail portion. The receiving portion extends from one end of the base portion for receiving and engaging with the pin of the external electrical device. The tail portion extends from another end of the base portion for electrically connecting to the printed circuit board. The receiving portion has two spring arms, at least two bent lines are defined on the two spring arms, respectively, and the receiving portion is bend along the bent lines to achieve pin receiving and engaging function.

Other objects, advantages and novel features of the present invention will be drawn from the following detailed description of preferred embodiment of the present invention with attached drawings, in which:

DESCRIPTION OF PREFERRED EMBODIMENT OF THE INVENTION

The present invention will be explained in detail by reference to the following description of the preferred embodiment.

Figure 1:
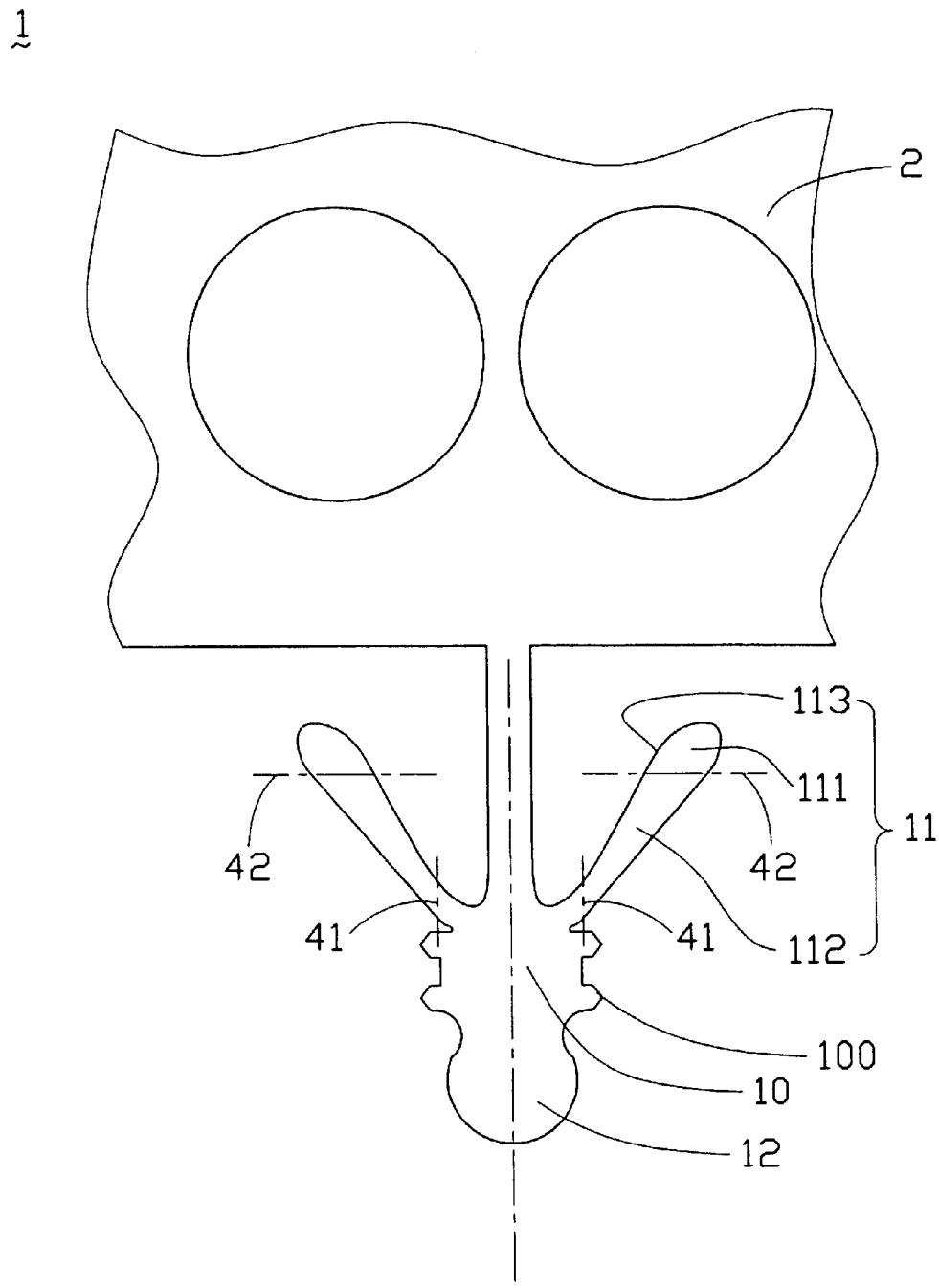
FIG. 1 is a cut-away perspective view of a carrier strip showing a contact in accordance with a preferred embodiment of the present invention.

As shown in FIG. 1, a CPU socket contact 1 which is stamped from a metal strip 2 in accordance with a preferred embodiment of the present invention comprises a base portion 10, a receiving portion 11, and a tail portion 12. The receiving portion 11 has a head portion 111 and a spring arm 112 for connecting the head portion 111 and the base portion 10. A contact edge 113 is defined on the head portion 111. A plurality of barbs is formed on the base portion 10 for being interferentially received into a CPU socket (not shown) to secure the contact 1 in position.

Figure 2:
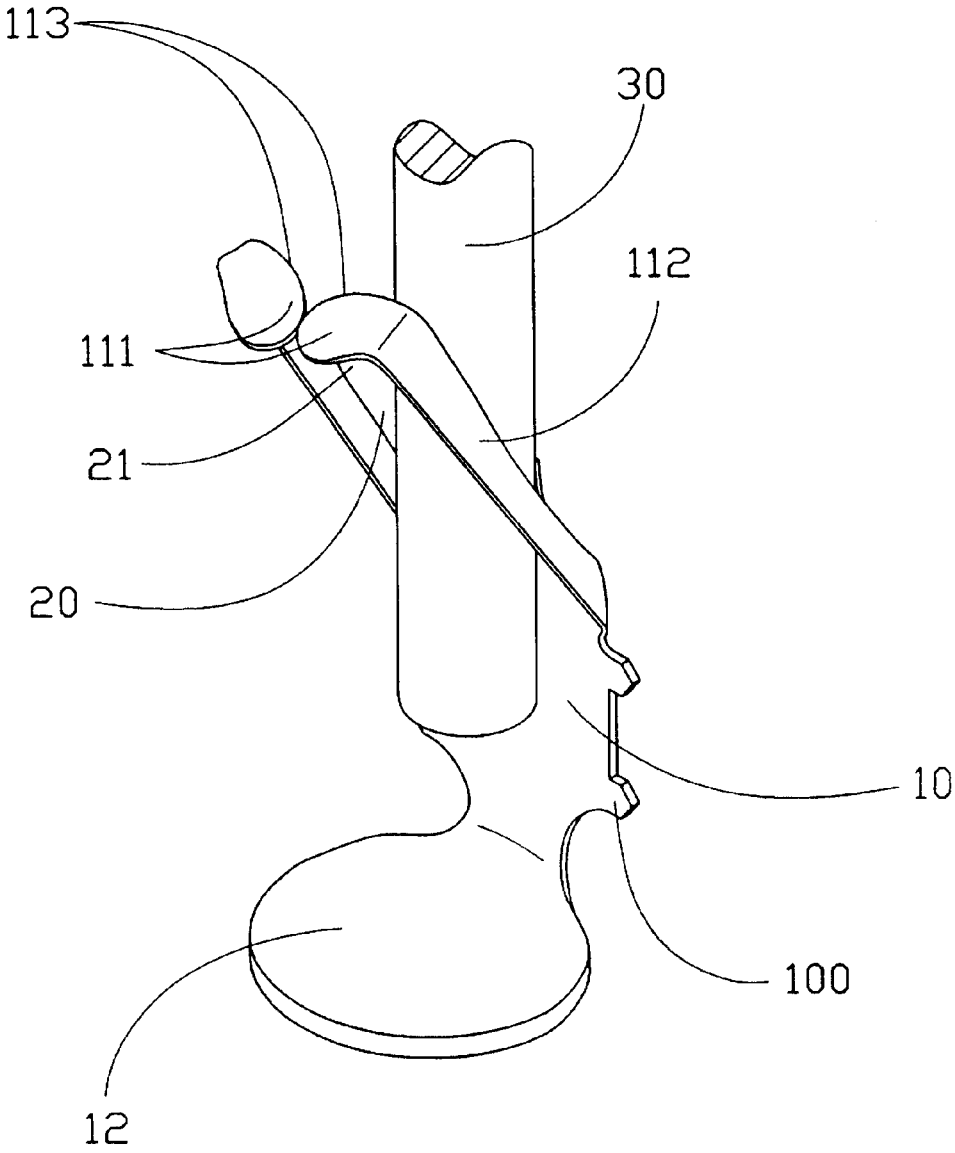
FIG. 2 is a perspective view of contact as formed and a pin of a CPU.

Referring to FIGS. 1 and 2, firstly, the spring arms 112 are bent along first bend lines 41 and positioned so that the spring arms 112 form a receiving section 20 for receiving a pin 30 of the a CPU (not shown) with zero insertion force. Then the head portions 111 are bent along second bend lines 42 which are positioned substantially vertically to the first bend lines 41. Therefore the head portions 111 form an engaging space 21 for clipping and electrically connecting with the pin 30. The tail portion 12 is bent vertically to the base portion 10. With such configuration, length of the spring arms 112 are increased while width of the spring arms 112 are remained, whereby resilient character of the receiving portion 11 is improved and the undesired plastic deformation of the receiving portion 11 is avoided.

Figure 3:
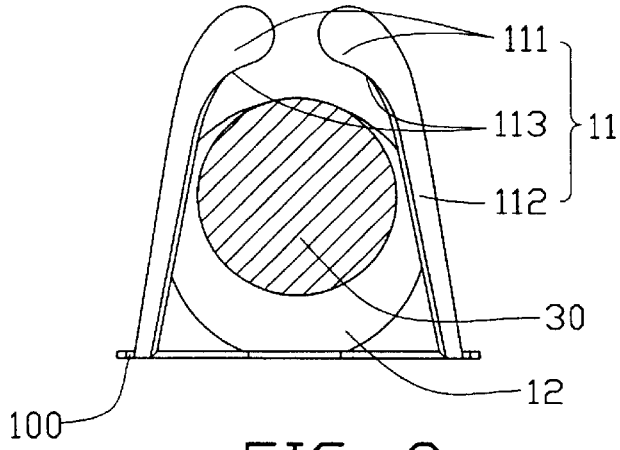
FIGS. 3, 4, and 5 are cross sectional views of the contact and the pin of FIG. 2 showing progressive stages of mating between the contact and the pin.

Referring to FIG. 3, when the pin 30 of the CPU is engaged with the contact 1, firstly the pin 30 is inserted in the receiving section 20 with zero insertion force, i.e., the pin 30 has no engagement with the receiving portion 11.

Figure 4:
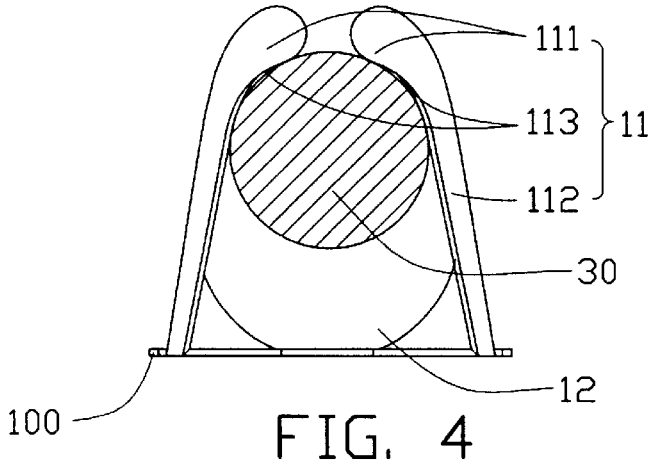

Referring to FIG. 4, when the pin 30 of the CPU is actuated toward the head portions 111 of the receiving portion 11, since diameter of the pin 30 is greater than the distance between the two head portions 111, the pin 30 will press the head portions 111 of the receiving portion 11 to move outwardly. Because of the resilient character of the slim receiving portion 11, the pin 30 is easily actuated from the receiving section 20 into the engaging space 21.

Figure 5:
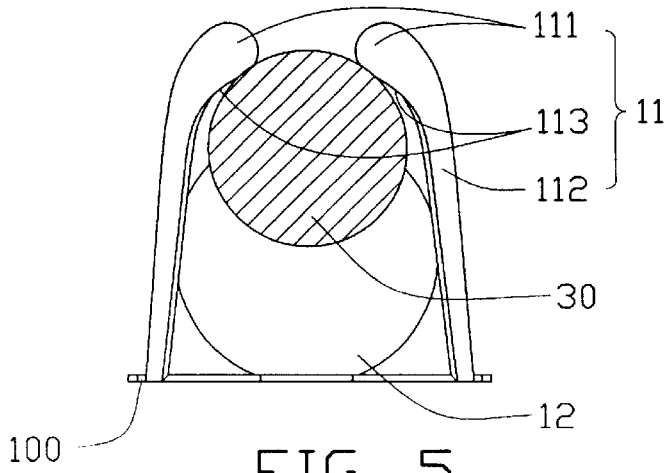
Figure 6:
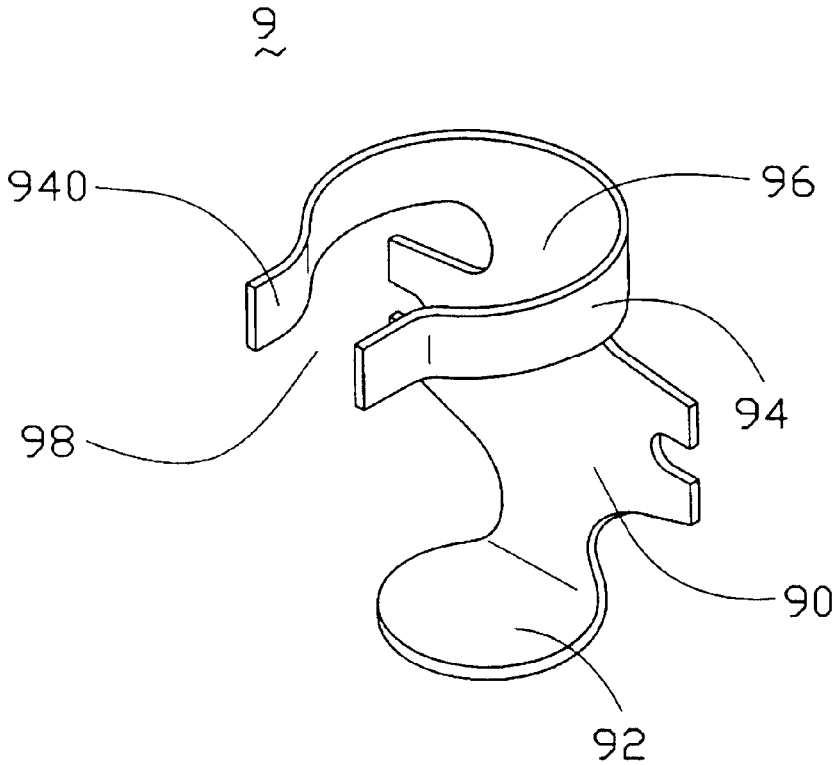
FIG. 6 (PRIOR ART)
FIG. 6 is a perspective view of a conventional contact.

Referring to FIG. 5, when the pin 30 of the CPU is actuated into the engaging space 21 furthermore, the receiving portion 11 goes on to open outwardly. When the pin 30 contacts and engages with the contact edge 113 of the receiving portion 11, and the pin 30 is positioned in predetermined position, the mating of the pin 30 and the contact 1 is completed.

Although the present invention has been described with reference to particular embodiments, it is not to be construed as being limited thereto. Various alterations and modifications can be made to the embodiment without in any way departing from the scope or spirit of the present invention as defined in the appended claims.

What is claimed is:

1. Contacts for electrically connecting CPU pin of an external electrical device with a printed circuit board, each contact comprising:

a vertical base portion;

a receiving portion obliquely upwardly extending from an upper end of the base portion for receiving and engaging with the pin of the external electrical device;

a tail portion horizontally extending from a lower end of the base portion for electrically connecting to the printed circuit board; and wherein the receiving portion has two spring arms, each arm having a width defining a main surface and a thickness, at least two bent lines are defined on the two spring arms, respectively, whereby said main surface of the spring arms face towards the pin of the external electrical device, and the receiving portion is bent along the bent lines to form a substantially closed circular space to accommodate the pin of the external electrical device;

wherein a head portion extends from the end of the spring arm and one bent line is defined between the spring arm and the head portion along a horizontal position;

wherein another bent line is defined between the spring arm and the base portion along a vertical position;

wherein the spring arm is positioned on the same side with the tail portion relative to the base portion;

wherein said head portions are properly configured and deflected relative to the corresponding spring arms to be compliantly receivably engaged with a circular configuration of the CPU pin when said CPU pin is initially moved toward and further successively contacts the head portions.

2. The contacts of claim 1, wherein the head portion has a contact edge for contacting with the pin.

3. The contacts of claim 1, wherein a plurality of barbs is formed on the base portion for securing the contact in position.

* * * * *